US008253765B2

(12) United States Patent
Shoji et al.

(10) Patent No.: US 8,253,765 B2
(45) Date of Patent: Aug. 28, 2012

(54) THERMAL HEAD AND MANUFACTURING METHOD FOR THE THERMAL HEAD

(75) Inventors: Noriyoshi Shoji, Chiba (JP); Norimitsu Sanbongi, Chiba (JP); Toshimitsu Morooka, Chiba (JP); Keitaro Koroishi, Chiba (JP)

(73) Assignee: Seiko Instruments Inc. (JP)

( * ) Notice: Subject to any disclaimer, the term of this patent is extended or adjusted under 35 U.S.C. 154(b) by 197 days.

(21) Appl. No.: 12/804,955

(22) Filed: Aug. 3, 2010

(65) Prior Publication Data

US 2011/0032320 A1 Feb. 10, 2011

(30) Foreign Application Priority Data

Aug. 6, 2009 (JP) ..... 2009-183554

(51) Int. Cl.
*B41J 2/335* (2006.01)

(52) U.S. Cl. ..... 347/200; 347/205

(58) Field of Classification Search ..... 347/200, 347/205, 202, 203
See application file for complete search history.

(56) References Cited

U.S. PATENT DOCUMENTS

| | | | | |
|---|---|---|---|---|
| 7,768,541 | B2 * | 8/2010 | Koroishi et al. | 347/202 |
| 7,852,361 | B2 * | 12/2010 | Shoji et al. | 347/206 |
| 8,111,273 | B2 * | 2/2012 | Morooka et al. | 347/204 |
| 8,122,591 | B2 * | 2/2012 | Shoji et al. | 29/611 |
| 8,144,175 | B2 * | 3/2012 | Koroishi et al. | 347/200 |
| 8,154,575 | B2 * | 4/2012 | Koroishi et al. | 347/207 |
| 2009/0090703 | A1 * | 4/2009 | Morooka et al. | 219/201 |
| 2010/0118105 | A1 * | 5/2010 | Morooka et al. | 347/206 |
| 2011/0025808 | A1 * | 2/2011 | Sanbongi | 347/200 |

FOREIGN PATENT DOCUMENTS

| | | |
|---|---|---|
| EP | 1780020 | 5/2007 |
| JP | 2006-321123 | * 11/2006 |
| JP | 2007-83532 | * 4/2007 |

* cited by examiner

*Primary Examiner* — Huan Tran
(74) *Attorney, Agent, or Firm* — Adams & Wilks

(57) ABSTRACT

Provided is a thermal head (1) including: a substrate body (12) constituted through bonding a flat supporting substrate (13) and a flat upper substrate (11), which are made of a glass material onto each other in a stacked state; a heating resistor (14) formed on a surface of the upper substrate (11); and a protective film (18) that partially covers the surface of the upper substrate (11) including the heating resistor (14) and protects the heating resistor (14), in which a heat-insulating concave portion (32) and thickness-measuring concave portions (34), which are open to a bonding surface between the supporting substrate and the upper substrate (11) and form cavities are provided in the supporting substrate (13), the heat-insulating concave portion (32) is formed at a position opposed to the heating resistor (14), and the thickness-measuring concave portions (34) is formed in a region that is prevented from being covered with the protective film (18). Thus, the thickness of the upper substrate is easily measured without decomposing the thermal head.

7 Claims, 7 Drawing Sheets

FIG. 7

| UPPER SUBSTRATE THICKNESS (μm) | TARGET RESISTANCE VALUE (Ω) |
|---|---|
| 10.0 OR MORE AND LESS THAN 12.5 | 220 |
| 12.5 OR MORE AND LESS THAN 15.0 | 210 |
| 15.0 OR MORE AND LESS THAN 17.5 | 200 |
| 17.5 OR MORE AND LESS THAN 20.0 | 190 |
| 20.0 OR MORE AND LESS THAN 22.5 | 180 |

THERMAL HEAD AND MANUFACTURING METHOD FOR THE THERMAL HEAD

BACKGROUND OF THE INVENTION

1. Field of the Invention

The present invention relates to a thermal head and a manufacturing method for the thermal head.

2. Description of the Related Art

There has been conventionally known a thermal head which is used in a thermal printer to be installed frequently in a small-sized information equipment terminal typified by a small-sized handy terminal, and which performs printing on a heat-sensitive recording medium by selectively driving some of a plurality of heating resistors based on printing data (for example, see Japanese Patent Application Laid-open No. 2007-83532).

For improving efficiency of the thermal head, there is a method of forming a cavity portion in a substrate that supports the heating resistors. This cavity portion functions as a hollow heat-insulating layer, whereby, among an amount of heat generated in the heating resistors, an amount of heat transferred downward, which is transferred toward the substrate, is reduced. Meanwhile, an amount of heat transferred upward, which is transferred to the above of the heating resistors, is increased. Thus, efficiency of energy required at the time of printing can be improved.

In a thermal head described in Japanese Patent Application Laid-open No. 2007-83532, an upper substrate and a supporting substrate, which are made of the same material such as glass, are bonded onto each other, whereby an integral substrate is constituted. A concave portion is provided in any one of the upper substrate and the supporting substrate, and the upper substrate and the supporting substrate are bonded and integrated with each other so as to close the concave portion, whereby a cavity portion is formed in an inside of the integral substrate. In the integral substrate as described above, the upper substrate functions as a support member that supports the heating resistors and the like, and also functions as a heat storage layer that stores heat from the heating resistors. Accordingly, a thickness dimension of the upper substrate is important in terms of performing quality control of the thermal head. In particular, when plate thinning treatment, surface treatment, or the like are performed to the upper substrate, variations may occur in the thickness of the upper substrate. Therefore, it is necessary to perform the quality control for the thermal head so as to eliminate the variations in the thickness of the upper substrate.

However, the upper substrate is integrated with the supporting substrate, and in addition, the heating resistors, a protective film, and the like are formed on a surface of the upper substrate. Therefore, the completed thermal head has a problem in that the thickness of only the upper substrate can be no longer measured. In the case of measuring the thickness of the upper substrate of the completed thermal head, the thickness must be measured after decomposing the thermal head.

SUMMARY OF THE INVENTION

The present invention has been made with reference to the above-mentioned circumstances. It is an object of the present invention to provide a thermal head capable of easily measuring the thickness of the upper substrate without decomposing the thermal head, and a manufacturing method for the thermal head.

In order to achieve the object described above, the present invention provides the following means.

According to the present invention, there is provided a thermal head comprising: a substrate constituted through bonding a flat supporting substrate and a flat upper substrate, which are made of a glass material onto each other in a stacked state; a heating resistor formed on a surface of the upper substrate; and a protective film that partially covers the surface of the upper substrate including the heating resistor and protects the heating resistor, in which a plurality of opening portions which are open to a bonding surface between the supporting substrate and the upper substrate and form cavities are provided in the supporting substrate, at least one of the opening portions is formed at a position opposed to the heating resistor, and at least another one of the other opening portions is formed in a region that is prevented from being covered with the protective film.

According to the present invention, the upper substrate arranged immediately under the heating resistor functions as a heat storage layer. Further, the cavity in the supporting substrate in which the opening portion is formed at the position opposed to the heating resistor functions as a hollow heat-insulating layer. Due to the cavity that functions as the hollow heat-insulating layer, an amount of heat transferred toward the supporting substrate through the upper substrate among an amount of heat generated in the heating resistor is reduced, and an amount of heat transferred to the above of the heating resistor and used for printing or the like is increased, whereby heating efficiency can be improved. Further, the heating resistor can be protected from abrasion and corrosion by the protective film.

Meanwhile, at a position of the opening portion provided in a region in which the surface of the upper substrate is prevented from being covered with the protective film, both of the surface and the back surface of the upper substrate face to the air. Specifically, the surface of the upper substrate is exposed to the outside, and the back surface thereof faces to the cavity formed by closing the opening portion.

Hence, even in a state where the upper substrate is bonded on the supporting substrate, if light is irradiated onto the above-mentioned region of the upper substrate, in which both of the surface and the back surface face to the air, the light can be reflected individually on the surface and the back surface of the upper substrate owing to a difference in refractive index between the upper substrate and the air. Thus, positions of the surface and the back surface of the upper substrate can be optically detected, and the thickness of the upper substrate can be easily measured without decomposing the thermal head.

In the above-mentioned invention, the opening portions may include concave portions dented in the bonding surface between the supporting substrate and the upper substrate or may include through holes which extend the supporting substrate in a thickness direction thereof.

According to the present invention, there is provided a manufacturing method for a thermal head, comprising: forming a plurality of opening portions open to one surface of a flat supporting substrate made of a glass material (opening portion forming step); bonding a flat upper substrate made of a glass material to the one surface of the supporting substrate, which includes the opening portions formed therein by the opening portion forming step so as to close the opening portions (bonding step); forming a heating resistor at a position of a surface of the upper substrate bonded in a stacked state onto the one surface of the supporting substrate by the bonding step, which is opposed to at least one of the opening portions (resistor forming step); and forming a protective film to be prevented from covering the surface opposed to the at least one of the opening portions, the protective film partially covering the surface of the upper substrate including the heating resistor formed by the resistor forming step (protective film forming step).

According to the present invention, by the bonding step, the plurality of opening portions open to the one surface of the supporting substrate are covered with the upper substrate, whereby cavity portions are individually formed. Further, the cavity portion formed at the position where the heating resistor is opposed to the opening portion functions as the hollow heat-insulating layer for the heat generated in the heating resistor. Thus, the amount of heat transferred toward the supporting substrate among the amount of heat generated in the heating resistor can be reduced, and it is possible to manufacture the thermal head having high heating efficiency, which is capable of increasing the amount of heat transferred to the above of the heating resistor and used for the printing or the like.

Meanwhile, both of the surface and the back surface of the upper substrate, which are opposed to the opening portion that is prevented from being covered with the protective film formed by the protective film forming step, face to the air. Hence, the positions of the surface and the back surface of the upper substrate can be optically detected by using the difference in refractive index between the upper substrate and the air. Thus, it is possible to manufacture the thermal head capable of easily measuring the thickness of the upper substrate after the thermal head is manufactured.

Further, in the above-mentioned invention, the manufacturing method for a thermal head may further include thinning the upper substrate bonded onto the one surface of the supporting substrate by the bonding step (plate thinning step).

With such a configuration, by the resistor forming step and the protective film forming step, the heating resistor and the protective film are formed on the surface of the thinned upper substrate. The thickness of the upper substrate is reduced by the plate thinning step, whereby the heat capacity of the upper substrate as the heat storage layer is lowered. Thus, it is possible to manufacture the thermal head capable of efficiently using the amount of heat, which is generated in the heating resistor, for the printing or the like.

Further, in the above-mentioned invention, the manufacturing method for a thermal head may further include: measuring a thickness of the upper substrate in such a manner that light is irradiated onto a region of the upper substrate, which is opposed to the opening portions formed at positions where the surface of the upper substrate is prevented from being covered with the protective film, and that positions of a surface and a back surface of the upper substrate are detected by rays reflected on the surface and the back surface (measurement step).

With such a configuration, by the measurement step, an accurate thickness dimension of the upper substrate can be measured only by irradiating the light through the surface of the upper substrate toward the opening portion formed at the position where the surface of the upper substrate is prevented from being covered with the protective film, and by detecting rays individually reflected on the surface and the back surface of the upper substrate. Thus, the thermal head can be manufactured, in which the accurate thickness of the upper substrate is already known.

Further, in the above-mentioned invention, the opening portion forming step may include: forming a plurality of sets of the plurality of opening portions in an arrayed manner, and after the protective film forming step, cutting the upper substrate and the supporting substrate for each of the plurality of sets of the opening portions (cutting step).

With such a configuration, a large number of the thermal heads can be manufactured at one time, and improvement in productivity and reduction of cost of the thermal heads can be achieved. In this case, even if the thickness is varied in the same large supporting substrate, the thickness of the upper substrates of all of the manufactured thermal heads can be controlled accurately.

According to the present invention, there is exerted an effect of easily measuring the thickness of the upper substrate without decomposing the thermal head.

BRIEF DESCRIPTION OF THE DRAWINGS

In the accompanying drawings:

FIG. 7 is a database in which the thickness of the upper substrate and a target resistance value of the heating resistors are associated with each other.

DETAILED DESCRIPTION OF THE PREFERRED EMBODIMENTS

A thermal head according to an embodiment of the present invention and a manufacturing method for the thermal head are described below with reference to the drawings.

Figure 1:
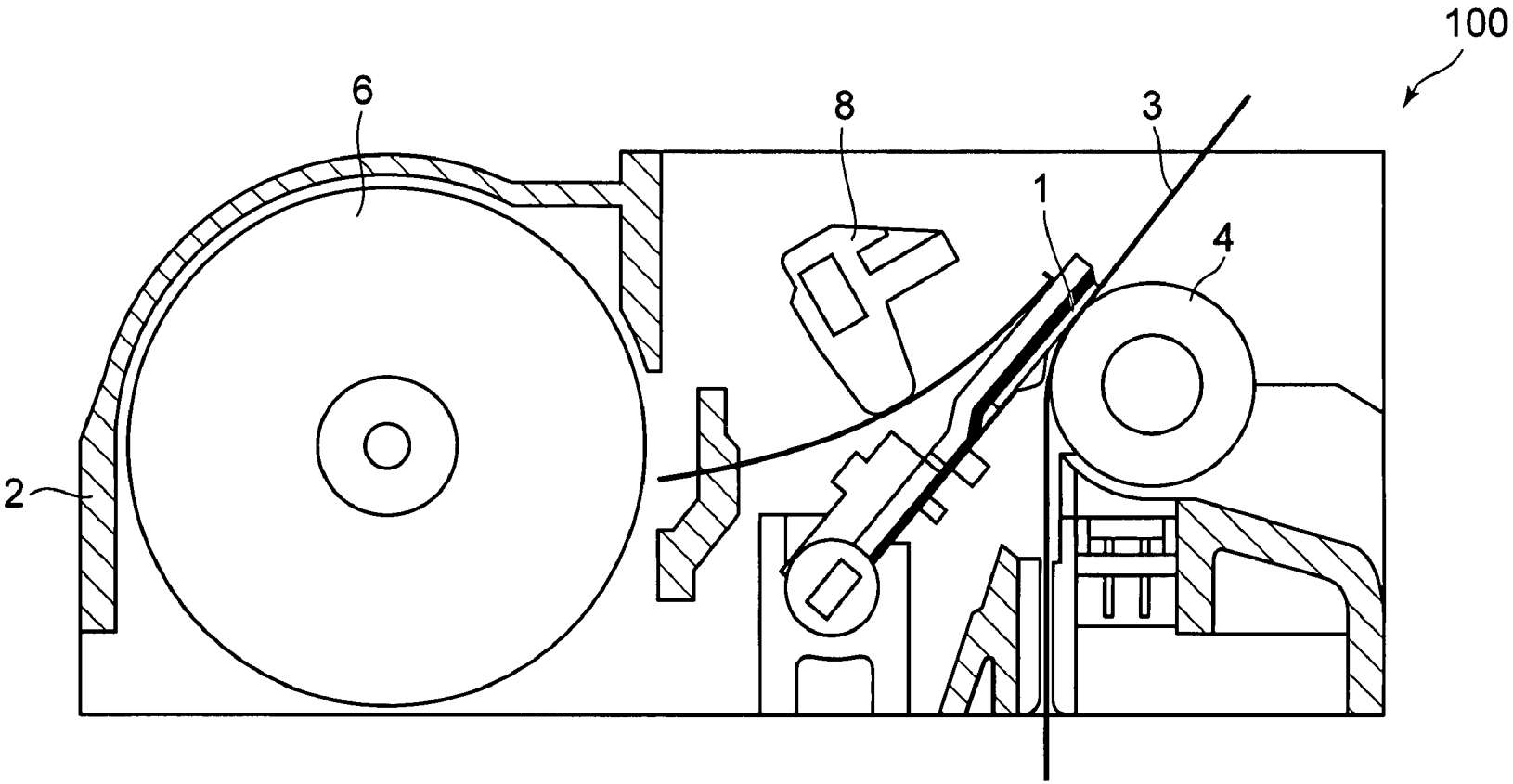
FIG. 1 is a schematic cross-sectional view of a thermal printer including a thermal head manufactured by a manufacturing method for a thermal head according to a embodiment of the present invention.

The thermal head 1 according to this embodiment is used for the thermal printer 100, for example, as illustrated in FIG. 1. The thermal printer 100 includes: a main body frame 2; a platen roller 4 arranged horizontally; the thermal head 1 arranged oppositely to an outer peripheral surface of the platen roller 4; a paper feeding mechanism 6 for feeding an object to be printed such as thermal paper 3 between the platen roller 4 and the thermal head 1; and a pressure mechanism 8 for pressing the thermal head 1 against the thermal paper 3 with a predetermined pressing force.

Against the platen roller 4, the thermal head 1 and the thermal paper 3 are pressed by the operation of the pressure mechanism 8. With this, load of the platen roller 4 is applied to the thermal head 1 through an intermediation of the thermal paper 3.

Figure 2:
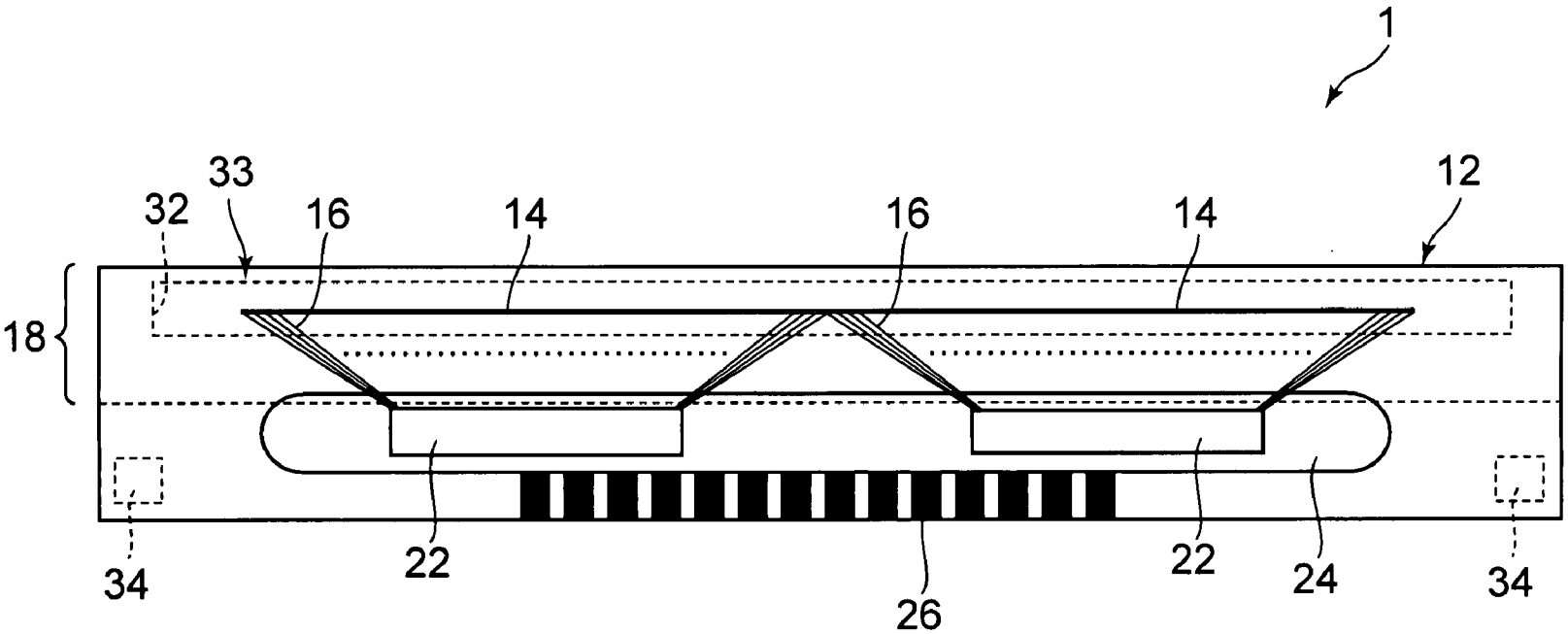
FIG. 2 is a plan view of the thermal head of FIG. 1 when viewed from a protective film side.

As illustrated in FIG. 2, the thermal head 1 is formed into a plate shape, and includes: a rectangular substrate body (substrate) 12; a plurality of heating resistors 14 arrayed at predetermined intervals on an upper surface of the substrate body 12; electrode wires 16 connected to the respective heating resistors 14; and a protective film 18 that partially covers the upper surface of the substrate body 12 including the heating resistors 14 and the electrode wires 16, and protects the heating resistors 14 and the electrode wires 16 from abrasion and corrosion. In FIG. 2, though the heating resistors 14 are represented as one straight line, actually, the plurality of resistors (for example, 4,096) thereof are arrayed at minute intervals in a longitudinal direction of the substrate body 12.

Further, on the upper surface of the substrate body 12, there are provided: driving integrated-circuits (ICs) 22 electrically connected to the respective heating resistors 14 through the electrode wires 16; an IC-coating resin film 24 that coats the driving ICs 22 to protect the driving ICs 22 from the abrasion and the corrosion, and is arranged on the upper surface of the substrate body 12; and a plurality (for example, approximately ten) of power supply portions 26 which supply electric power energy to the heating resistors 14.

Figure 3:
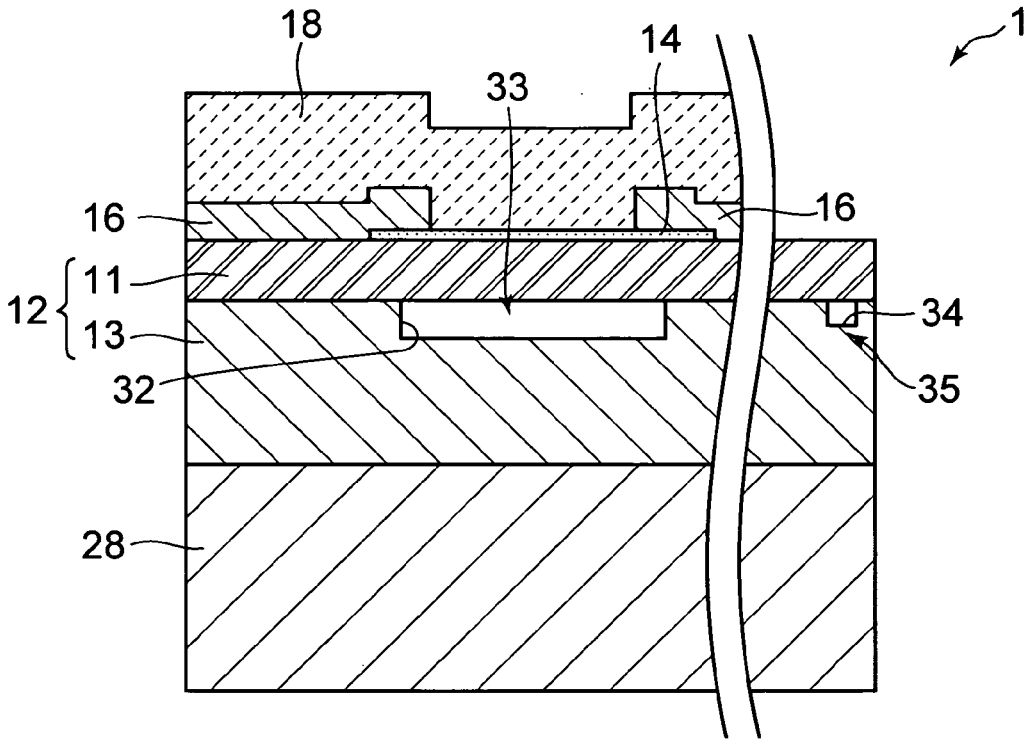
FIG. 3 is a longitudinal cross-sectional view of the thermal head of FIG. 2 taken along a direction perpendicular to a longitudinal direction of the thermal head.

As illustrated in FIG. 3, the substrate body 12 is fixed to a heat radiating plate 28 as a plate-like member made of metal such as aluminum, a resin, ceramics, glass, or the like, and heat of the thermal head 1 can be radiated through the heat radiating plate 28. This substrate body 12 is constituted in such a manner that the flat upper substrate 11 on which the heating resistors 14, the driving ICs 22, and the like are formed and a flat supporting substrate 13 for supporting the upper substrate 11 are bonded onto each other in a stacked state.

The upper substrate 11 is a glass substrate having a thickness approximately ranging from 10 to 50 μm. The upper substrate 11 is arranged immediately under the heating resistors 14, and thereby functions as a heat storage layer that stores a part of heat emitted from the heating resistors 14.

The supporting substrate 13 is an insulative glass substrate having a thickness, for example, approximately ranging from 300 μm to 1 mm. Note that, as the supporting substrate 13 and the upper substrate 11, it is desirable to use glass substrates made of the same materials or glass substrates similar in property to each other.

In the supporting substrate 13, a heat-insulating concave portion (opening portion) 32 and two thickness-measuring concave portions (opening portions) 34, which are recessed in a bonding surface between the supporting substrate 13 and the upper substrate 11, are formed (hereinafter, the heat-insulating concave portion 32 and the thickness-measuring concave portions 34 are also referred to as "concave portions 32 and 34").

The heat-insulating concave portion 32 is formed into a rectangular shape extending in a longitudinal direction of the supporting substrate 13, and is arranged at a position opposed to all of the heating resistors 14.

The thickness-measuring concave portions 34 are formed into a square shape having an opening width of approximately 100 μm, and are arranged at positions which are prevented from being covered with the protective film 18 and the IC-coating resin film 24 on the upper substrate 11. For example, the thickness-measuring concave portions 34 are arranged in the vicinities of corners in the bonding surface of the supporting substrate 13.

With regard to the upper substrate 11 and the supporting substrate 13, the upper substrate 11 is bonded in a stacked state to one surface of the supporting substrate 13 so as to close the concave portions 32 and 32. The concave portions 32 and 34 are covered with the upper substrate 11, whereby a heat-insulating cavity portion 33 and thickness-measuring cavity portions 35 are individually formed between the upper substrate 11 and the supporting substrate 13.

The heat-insulating cavity portion 33 functions as a hollow heat-insulating layer that suppresses the heat generated in the heating resistors 14 formed on an upper layer thereof from being transferred from the upper substrate 11 toward the supporting substrate 13, and has a communication structure opposed to all of the heating resistors 14.

On the surface of the upper substrate 11, the heating resistors 14 are provided so as to straddle the heat-insulating cavity portion 33 in a width direction thereof, and are arrayed at predetermined intervals in a longitudinal direction of the heat-insulating cavity portion 33. Specifically, the respective heating resistors 14 are arrayed at positions opposed to the heat-insulating cavity portion 33 while interposing the upper substrate 11 therebetween.

The electrode wires 16 include: individual electrode wires connected to one-side ends of the respective heating resistors 14, which are located in a direction perpendicular to an array direction thereof; and common electrode wires integrally connected to other-side ends of all of the heating resistors 14.

The driving ICs 22 are devices which individually control heating operations of the respective heating resistors 14. The driving ICs 22 are capable of driving the selected heating resistors 14 while controlling voltage applied thereto through the individual electrode wires. On the upper substrate 11, two driving ICs 22 are arranged at an interval along the array direction of the heating resistors 14, and a half number of the heating resistors 14 are individually connected to each of the driving ICs 22 through the individual electrode wires.

When the voltage is selectively applied to the individual electrode wires by the driving ICs 22, current flow through the heating resistors 14 connected to the selected individual electrode wires, and the heating resistors 14 generate heat. In this state, the thermal paper 3 is pressed against a surface portion (printing portion) of the protective film 18 that covers such heating portions of the heating resistors 14 by the actuation of the pressure mechanism 8, and then the thermal paper 3 changes its color. As a result, the printing is performed.

The heat-insulating cavity portion 33 functions as the hollow heat-insulating layer, whereby an amount of heat transferred in a direction of the protective film 18 adjacent to one-side surfaces of the heating resistors 14 is increased more than an amount of heat transferred to the upper substrate 11 adjacent to other-side surfaces of the heating resistors 14. At the time of printing, the thermal paper 3 is pressed against the protective film 18, and accordingly, the amount of heat in the direction of the protective film 18 is increased, whereby an amount of heat for use in the printing or the like is increased, and utilization efficiency of the heat can be improved.

At positions of the thickness-measuring cavity portions 35, both of the surface and the back surface of the upper substrate 11 face to the air. Specifically, the surface of the upper substrate 11 is exposed to the outside and is held in contact with the outside air, and the back surface thereof is held in contact with the air in the thickness-measuring cavity portions 35 formed by closing the thickness-measuring concave portions 34.

A description is made below of a manufacturing method for the thermal head 1 constituted as described above.

Figure 4:
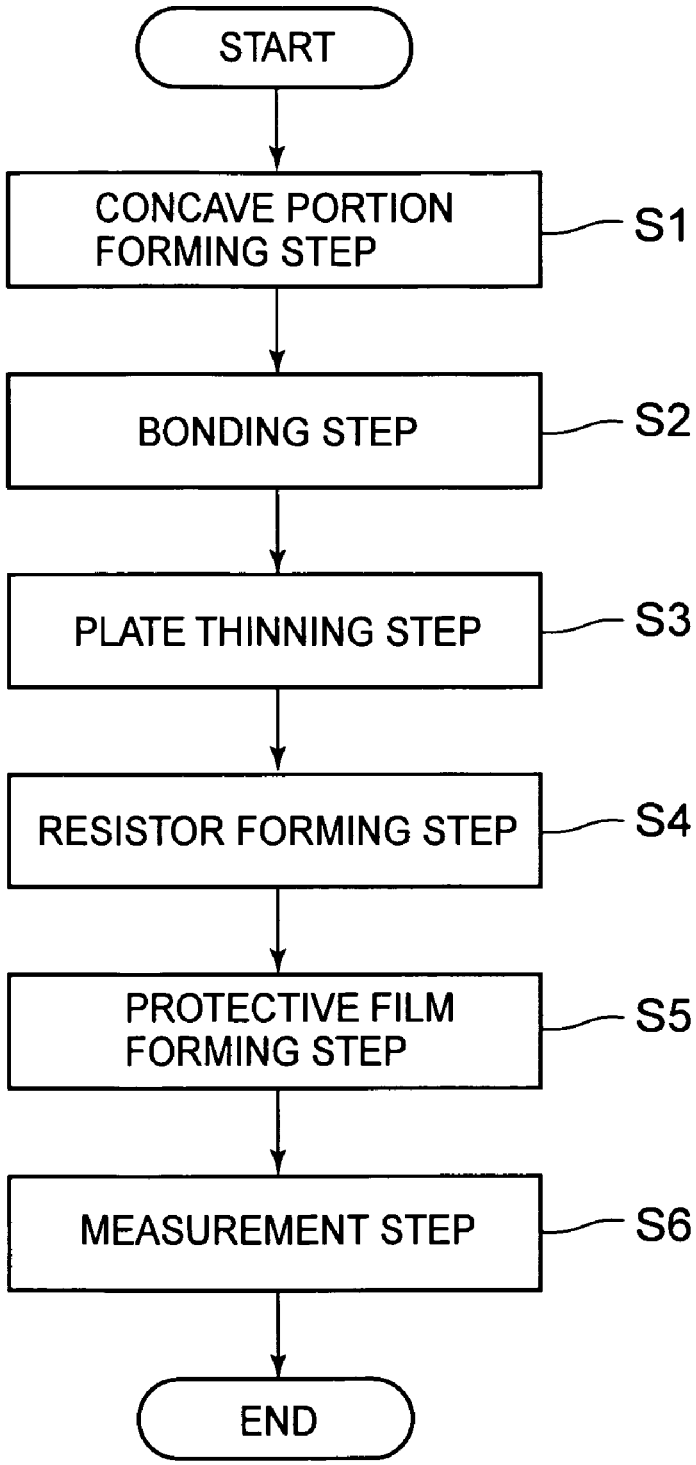
FIG. 4 is a flowchart of a manufacturing method for the thermal head according to the embodiment of the present invention.

As illustrated in a flowchart of FIG. 4, the manufacturing method for the thermal head 1 according to this embodiment includes: a concave portion forming step (opening portion forming step) S1 of forming the concave portions 32 and 34 open to the one surface of the supporting substrate 13; a bonding step S2 of bonding the upper substrate 11 to the one surface of the supporting substrate 13, in which the concave portions 32 and 34 are formed, so as to close the concave portions 32 and 34; a resistor forming step S4 of forming the heating resistors 14 at the position of the surface of the upper substrate 11 bonded onto the one surface of the supporting substrate 13, which is opposed to the heat-insulating concave portion 32; and a protective film forming step S5 of forming the protective film 18 on the upper substrate 11 to be prevented from covering a surface of the upper substrate 11, which is opposed to the thickness-measuring concave portions 34.

In the following, the above-mentioned steps are described in detail.

First, in the concave portion forming step S1, the heat-insulating concave portion 32 is formed at the position of the one surface of the supporting substrate 13, which is opposed to the heating resistors 14, and in addition, the thickness-measuring concave portions 34 are formed in a region of the one surface of the supporting substrate 13, which are prevented from being covered with the protective film 18 and the IC-coating resin film 24 (Step S1). The concave portions 32 and 34 can be formed by performing, for example, sandblasting, dry etching, wet etching, or laser machining on the one surface of the supporting substrate 13.

When the sandblasting is performed on the supporting substrate 13, the one surface of the supporting substrate 13 is covered with a photoresist material, and the photoresist material is exposed to light using a photomask of a predetermined pattern, whereby there is cured a portion other than the region in which the concave portions 32 and 34 are formed.

After that, by cleaning the one surface of the supporting substrate 13 and removing the photoresist material which is not cured, etching masks (not shown) having etching windows formed in the region in which the concave portions 32 and 34 are formed can be obtained. In this state, the sandblasting is performed on the one surface of the supporting substrate 13, and the concave portions 32 and 34 having a predetermined depth are individually formed. Note that, it is preferred that the depth of the heat-insulating concave portion 32 be, for example, 10 μm or more and half or less of the thickness of the supporting substrate 13. Further, it is preferred that the opening width of the thickness-measuring concave portions 34 be, for example, about 100 μm.

Further, when etching, such as the dry etching and the wet etching, is performed, as in the case of the sandblasting, the etching masks having the etching windows formed in the region in which the concave portions 32 and 34 are formed are formed in the one surface of the supporting substrate 13. In this state, by performing the etching on the one surface of the supporting substrate 13, the concave portions 32 and 34 having the predetermined depth are formed.

As such an etching process, there can be used, for example, the wet etching using hydrofluoric acid-based etchant or the like, and the dry etching such as reactive ion etching (RIE) and plasma etching. Note that, as a reference example, in the case of a single-crystal silicon supporting substrate, there is performed the wet etching using the etchant such as tetramethylammonium hydroxide solution, KOH solution, and mixing solution of hydrofluoric acid and nitric acid.

Next, in the bonding step S2, the etching mask is entirely removed from the one surface of the supporting substrate 13, and the surface is cleaned. Then, the upper substrate 11 is superposed onto the one surface of the supporting substrate 13 so as to close the concave portions 32 and 34. For example, the upper substrate 11 is directly superposed onto the supporting substrate 13 at room temperature without using an adhesion layer.

The one surface of the supporting substrate 13 is covered with the upper substrate 11, in other words, opening portions of the concave portions 32 and 34 are closed by the upper substrate 11, whereby the heat-insulating cavity portion 33 and the thickness-measuring cavity portions 35 are individually formed between the upper substrate 11 and the supporting substrate 13. In this state, heating treatment is performed to the upper substrate 11 and the supporting substrate 13, which are superposed on each other, and the upper substrate 11 and the supporting substrate 13 are bonded onto each other by thermal fusing (Step S2).

Here, a material having a thickness of 100 μm or less, which constitutes the upper substrate 11, is difficult to manufacture and handle, and in addition, is expensive. Accordingly, in place of directly bonding such an originally thin upper substrate 11 to the supporting substrate 13, the upper substrate 11 having a thickness to allow easy handling and manufacturing thereof may be bonded onto the supporting substrate 13, and thereafter, the upper substrate 11 may be processed by the etching, the polishing, or the like so as to have a desired thickness (Step S3, in other words, plate thinning step S3).

By the plate thinning step S3, the upper substrate 11 that is extremely thin can be formed on the one surface of the supporting substrate 13 easily and inexpensively. Further, the thickness of the upper substrate 11 is reduced, whereby a heat capacity of the upper substrate 11 as the heat storage layer is lowered. Thus, it is possible to manufacture the thermal head 1 capable of efficiently using an amount of heat, which is generated in the heating resistors 14, for the printing or the like.

For the etching of the upper substrate 11, various etchings adopted for forming the concave portions 32 and 34 can be used as in the concave portion forming step S1. Further, for the polishing of the upper substrate 11, for example, chemical mechanical polishing (CMP) or the like, which is used for high accuracy polishing for a semiconductor wafer and the like, can be used.

Next, in the resistor forming step S4, the heating resistors 14 are formed at positions on the upper substrate 11, which are opposed to the heat-insulating concave portion 32 (Step S4).

Here, there can be used a thin film forming method such as sputtering, chemical vapor deposition (CVD), or vapor deposition. A thin film is molded from a heating resistor material such as a Ta-based material or a silicide-based material on the upper substrate 11. The thin film of the heating resistor material is molded by lift-off, etching, or the like to form the heating resistors 14 having a desired shape.

Next, similarly to the resistor forming step S4, the film formation with use of a wiring material such as Al, Al—Si, Au, Ag, Cu, and Pt is performed on the upper substrate 11 by using sputtering, vapor deposition, or the like. Then, the film thus obtained is formed by lift-off or etching, or the wiring material is screen-printed and is, for example, burned thereafter, to thereby form the electrode wires 16. Note that, the order of forming the heating resistors 14 and the electrode wires 16 is arbitrary. In the patterning of a resist material for the lift-off or etching for the heating resistors 14 and the electrode wires 16, the patterning is performed on the photoresist material by using a photomask.

Next, in the protective film forming step S5, the film formation with use of a protective film material such as $SiO_2$, $Ta_2O_5$, SiAlON, $Si_3N_4$, or diamond-like carbon is performed by sputtering, ion plating, CVD, or the like on the upper substrate 11 on which the heating resistors 14 and the electrode wires 16 are formed, whereby the protective film 18 is formed (Step S5).

In this case, the protective film 18 is formed so as to partially cover the surface of the upper substrate 11 including the heating resistors 14 and the electrode wires 16 and to be prevented from covering the surface opposed to the thickness-measuring concave portions 34. In this manner, at the positions of the thickness-measuring concave portions 34, both of the surface and the back surface of the upper substrate 11 face to the air.

Note that, the driving ICs 22, the IC-coating resin film 24, and the power supply portions 26 can be formed by using the publicly known manufacturing method for the conventional thermal head.

By the steps described above, the thermal head 1 illustrated in FIG. 2 and FIG. 3 is manufactured.

Here, the manufacturing method for the thermal head 1 according to this embodiment may further include a measurement step S6 of measuring the thickness of the upper substrate 11 of the manufactured thermal head 1.

In the measurement step S6, it is sufficient that the thickness of the upper substrate 11 is measured in such a manner that light is irradiated onto the regions of the upper substrate 11, which are opposed to the thickness-measuring concave portions 34, and positions of the surface and the back surface of the upper substrate 11 are detected by rays reflected on the surface and the back surface of the upper substrate 11 (step S6).

Figure 5:
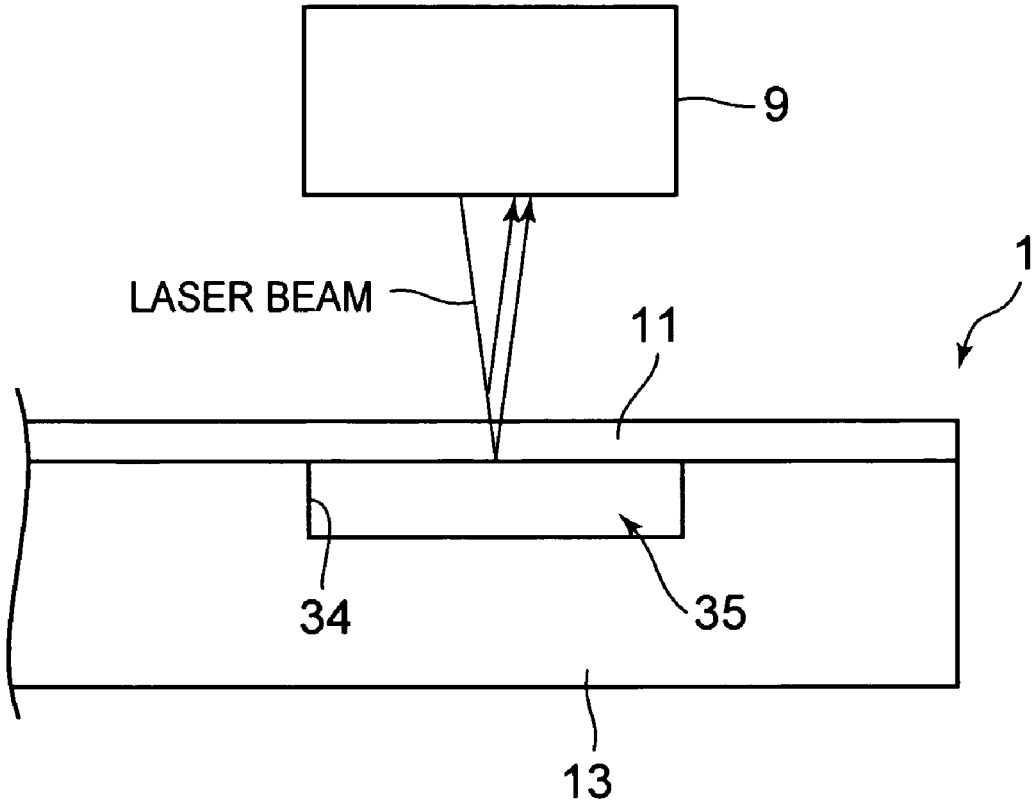
FIG. 5 is a schematic sectional view illustrating a state of measuring a thickness of an upper substrate of the thermal head of FIG. 1.

As described above, at the positions of the thickness-measuring concave portions 34, both of the surface and the back surface of the upper substrate 11 face to the air. Accordingly, for example, as illustrated in FIG. 5, when a blue laser beam is irradiated toward the thickness-measuring concave portions 34 through the surface of the upper substrate 11, the blue laser beam is reflected on the surface and the back surface of the upper substrate 11 owing to a difference in refractive index between the upper substrate 11 and the air.

Hence, only by detecting the rays individually reflected on the surface and the back surface of the upper substrate 11 by a sensor 9 or the like, an accurate thickness dimension of the upper substrate 11 can be optically measured. In this manner, the thermal head 1 in which the accurate thickness of the upper substrate 11 is already known can be manufactured. Note that, if a spot diameter of the general blue laser is 0.9μ, positional alignment of a laser spot can be easily performed through setting the opening width of the thickness-measuring concave portions 34 to approximately 100 μm.

As described above, in accordance with the thermal head 1 according to this embodiment, in the completed thermal head 1, the positions of the surface and the back surface of the upper substrate 11, which are opposed to the thickness-measuring concave portions 34, can be optically detected, and the thickness of the upper substrate 11 can be easily measured without decomposing the thermal head 1. Further, in accordance with the manufacturing method for the thermal head 1 according to this embodiment, the thermal head 1 as described above can be manufactured.

Note that, in this embodiment, the description is made through illustrating the concave portions 32 and 34 as the opening portions. However, in place of the concave portions 32 and 34, for example, through holes may be used, which extend the supporting substrate 13 in a thickness direction thereof.

Further, in this embodiment, the description is made of the manufacturing method while focusing on the single thermal head 1. However, in order to form a large number of the thermal heads 1 from the large upper substrate and supporting substrate, it is sufficient that a plurality of sets of the concave portions 32 and 34 are formed in an arrayed manner in the concave portion forming step S1, and after the protective film forming step S5, the upper substrate and the supporting substrate are cut for each set of the concave portions 32 and 34 (cutting step). In this manner, a large number of the thermal heads 1 can be manufactured at one time, and improvement in productivity and reduction of cost of the thermal heads 1 can be achieved. In this case, even if the thickness is varied in the same large supporting substrate, the thickness of the upper substrates 11 of all of the manufactured thermal heads 1 can be controlled accurately.

Figure 6:
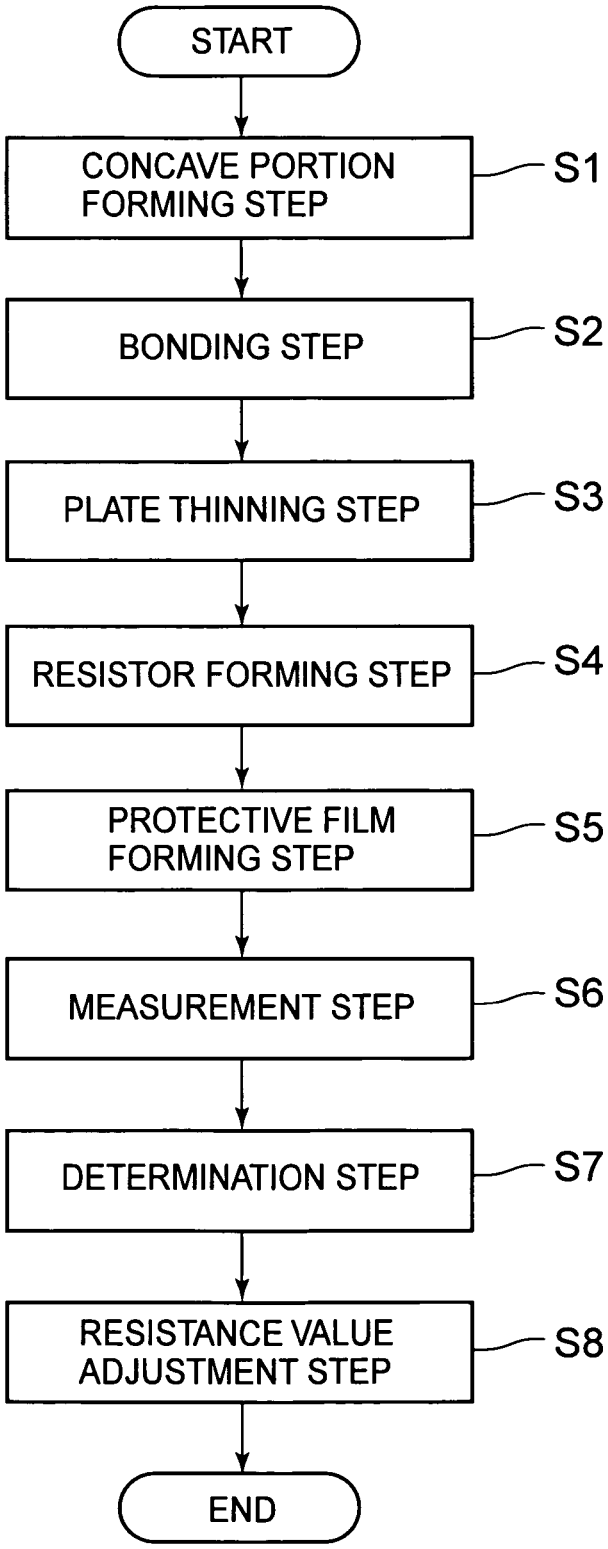
FIG. 6 is a flowchart in which an adjustment step of a resistance value of heating resistors is added to the flowchart of FIG. 4.

Moreover, as illustrated in the flowchart of FIG. 6, the manufacturing method for the thermal head 1 according to this embodiment may further include the following steps for adjusting the resistance value of the heating resistors 14.

Specifically, the manufacturing method may further include: a determination step S7 of determining a target resistance value of the heating resistors 14 based on the thickness of the upper substrate 11, which is measured by the measurement step S6; and a resistance value adjustment step S8 of adjusting the resistance value of the heating resistors 14 so as to substantially confirm with the target resistance value determined by the determination step S7. In this case, for example, in the resistor forming step S4, such heating resistors 14 that have a resistance value higher than the target resistance value are formed in advance.

In the determination step S7, it is sufficient that the target resistance value is read from a database as illustrated in FIG. 7, in which the thickness of the upper substrate 11 and the target resistance value are associated with each other. In this manner, the target resistance value of the heating resistors 14 can be determined easily and rapidly based on the database. Further, it is sufficient that the target resistance value is set so that a desired amount of heat can become usable depending on the thickness of the upper substrate 11.

Next, in the resistance value adjustment step S8, it is sufficient that predetermined energy is applied to the heating resistors 14, whereby the resistance value of the heating resistors 14 is lowered to substantially confirm with the target resistance value. In this manner, the resistance value of the heating resistors 14 can be changed easily in a short time. As the predetermined energy, for example, a voltage pulse may be used, or a laser beam may be used.

In the case of applying the voltage pulse to the heating resistors 14, the resistance value can be easily changed only by applying a voltage pulse with a higher voltage than at the time of a usual printing operation to the heating resistors 14 without using a special apparatus for adjusting the resistance value of the heating resistors 14. Further, in the case of irradiating the laser beam onto the heating resistors 14, a resistance value of a portion onto which the laser beam is irradiated can be partially changed. Further, by changing an irradiation width of the laser beam, a range where the resistance value of the heating resistors 14 is changed can be easily adjusted.

Here, the upper substrate 11 is thinned by the plate thinning step S3, whereby the heat capacity of the upper substrate 11 as the heat storage layer is lowered. In this manner, an amount of heat absorbed by the upper substrate 11 among the amount of heat generated in the heating resistors 14 is suppressed, and the amount of usable heat is increased. Hence, the amount of heat usable by the thermal head 1 is varied depending on the thickness of the upper substrate 11 thinned by the plate thinning step S3.

Accordingly, by the resistance value adjustment step S8, the resistance value of the heating resistors 14 is adjusted so as to substantially confirm with the target resistance value determined by the determination step S7 based on the thickness of the upper substrate 11 thinned in the plate thinning step S3. Thus, it is possible to manufacture the thermal head 1 that is capable of using the desired amount of heat irrespective of the thickness of the upper substrate 11.

Note that, it is possible that such heating resistors 14 that have a resistance value lower than the target resistance value are formed in the resistor forming step S4, and the laser beam is irradiated thereonto, and so on, whereby the resistance value of the heating resistors 14 is raised to substantially confirm with the target resistance value.

What is claimed is:

1. A thermal head, comprising:

a substrate constituted through bonding a flat supporting substrate and a flat upper substrate, which are made of a glass material, onto each other in a stacked state;

a heating resistor formed on a surface of the upper substrate; and a protective film that partially covers the surface of the upper substrate including the heating resistor and protects the heating resistor, wherein a plurality of opening portions which are open to a bonding surface between the supporting substrate and the upper substrate and form cavities are provided in the supporting substrate, wherein at least one of the opening portions is formed at a position opposed to the heating resistor, and wherein at least another one of the opening portions is formed in a region that is prevented from being covered with the protective film.

2. A thermal head according to claim 1, wherein the opening portions comprise concave portions dented in the bonding surface between the supporting substrate and the upper substrate.

3. A thermal head according to claim 1, wherein the opening portions comprise through holes which extend the supporting substrate in a thickness direction thereof.

4. A manufacturing method for a thermal head, comprising:

forming a plurality of opening portions open to one surface of a flat supporting substrate made of a glass material (opening portion forming step);

bonding a flat upper substrate made of a glass material onto the one surface of the supporting substrate, which includes the opening portions formed therein by the opening portion forming step so as to close the opening portions (bonding step);

forming a heating resistor at a position of a surface of the upper substrate bonded in a stacked state onto the one surface of the supporting substrate by the bonding step, which is opposed to at least one of the opening portions (resistor forming step); and forming a protective film to be prevented from covering the surface opposed to the at least one of the opening portions, the protective film partially covering the surface of the upper substrate including the heating resistor formed by the resistor forming step (protective film forming step).

5. A manufacturing method for a thermal head according to claim 4, further comprising thinning the upper substrate bonded onto the one surface of the supporting substrate by the bonding step (plate thinning step).

6. A manufacturing method for a thermal head according to claim 4, further comprising measuring a thickness of the upper substrate in such a manner that light is irradiated onto a region of the upper substrate, which is opposed to the opening portions formed at positions where the surface of the upper substrate is prevented from being covered with the protective film, and that positions of a surface and a back surface of the upper substrate are detected by rays reflected on the surface and the back surface (measurement step).

7. A manufacturing method for a thermal head according to claim 4, wherein the opening portion forming step comprises forming a plurality of sets of the plurality of opening portions in an arrayed manner, and after the protective film forming step, cutting the upper substrate and the supporting substrate for each of the plurality of sets of the opening portions (cutting step).

* * * * *